US012364920B2

(12) United States Patent
Robinson

(10) Patent No.: US 12,364,920 B2
(45) Date of Patent: Jul. 22, 2025

(54) SKATEBOARD FOOT STRAP SYSTEM

(71) Applicant: Adam Robinson, Yukon, OK (US)

(72) Inventor: Adam Robinson, Yukon, OK (US)

( * ) Notice: Subject to any disclaimer, the term of this patent is extended or adjusted under 35 U.S.C. 154(b) by 86 days.

(21) Appl. No.: 18/499,969

(22) Filed: Nov. 1, 2023

(65) Prior Publication Data

US 2024/0157225 A1 May 16, 2024

Related U.S. Application Data

(60) Provisional application No. 63/424,729, filed on Nov. 11, 2022.

(51) Int. Cl.
*A63C 17/26* (2006.01)
*A63C 17/00* (2006.01)

(52) U.S. Cl.
CPC .... *A63C 17/262* (2013.01); *A63C 2017/0053* (2013.01)

(58) Field of Classification Search
CPC ..... A63C 17/262; A63C 2017/0053
See application file for complete search history.

(56) References Cited

U.S. PATENT DOCUMENTS 6,199,881 B1 * 3/2001 Wood ..... A63C 17/262 441/74
8,025,300 B1 * 9/2011 Jordan ..... A63C 17/16 280/87.041
11,383,141 B1 * 7/2022 Swift ..... A63B 21/0555
2003/0075890 A1 * 4/2003 Jacobs ..... A63C 10/02 280/87.042
2004/0104551 A1 * 6/2004 Jacobs ..... A63C 17/013 280/87.042
2010/0059957 A1 * 3/2010 Haskell ..... A63C 17/01 36/1
2012/0227651 A1 * 9/2012 Kuntzel ..... A63C 17/262 441/75
2016/0129743 A1 * 5/2016 DeFerrari ..... B60F 3/003 280/7.15
2016/0184690 A1 * 6/2016 Aders ..... A63C 17/262 180/20
2019/0015729 A1 * 1/2019 Sullivan ..... A63C 17/262
2019/0381390 A1 * 12/2019 Wendelschafer ..... A63C 17/01

* cited by examiner

*Primary Examiner* — Brian L Swenson

(57) ABSTRACT

A skateboard foot strap system is provided which may have a plurality of coupling discs each having a top portion and bottom portion. Further, the top portion may comprise a plurality of concave down edge structures where each of the plurality of concave down edge structures may terminate into a planar top surface, each of the plurality of concave down edge structures may terminate into a planar bottom surface, and the bottom portion may utilize a plurality of threaded bolts extending from the planar bottom surface and may be structured to be disposed through respective coupling apertures. Further, the system may utilize an elongate flexible foot strap having a first width dimension smaller than that of a second width dimension of each of the plurality of coupling discs. The elongate flexible foot strap may be disposed between the plurality of threaded bolts.

20 Claims, 8 Drawing Sheets

200d

SKATEBOARD FOOT STRAP SYSTEM

CROSS-REFERENCE TO RELATED APPLICATIONS

This application claims priority to U.S. Provisional Patent Application Ser. No. 63/424,729, entitled "Skateboard Foot Strap System," filed Nov. 11, 2022. The contents of this application are hereby incorporated by reference in their entirety.

BACKGROUND OF THE INVENTION

Skateboarding, a widely popular sport and recreational activity, has seen significant growth and innovation over the years. Emerging as a pastime in the mid-20th century, skateboarding has grown from empty pool bowls to sprawling skateparks, witnessing a dramatic transformation in terms of board designs, materials, and accessories. As the industry has advanced, the need for accessory innovation has become more pronounced, emphasizing safety, performance enhancement, and convenience.

The landscape of the skateboard accessory industry boasts a wide variety of products. From protective gear like helmets and pads to tools, wheels, and bearings, the market is saturated with options tailored to the diverse needs of skateboarders. However, while there are numerous accessories available, there remains a noticeable gap in products specifically designed to improve the boarding experience in terms of maneuverability, stability, and trick execution.

A common challenge faced by skateboarders, particularly those aspiring to master complex tricks, is the difficulty in maintaining foot placement and grip on the board during jumps, spins, or flips. Traditional solutions, such as grip tape, provide some traction but lack the security needed for advanced moves. Transporting a skateboard can also be cumbersome, often requiring the skateboarder to carry it by hand, which can be inconvenient during long commutes or when multi-tasking.

Surveying the market, several skateboard accessories like adjustable trucks, specialized wheels for various terrains, and even electronic skateboard kits are available. Still, very few focus on enhancing the direct relationship between the skateboarder's feet and the board itself. This oversight leaves a gap for an innovative solution that not only improves trick execution but also addresses the challenge of board transportation.

In light of these challenges, there emerges a need for a system or product that can securely anchor a skateboarder's feet to the board, ensuring stability during complex maneuvers and potentially reducing the risk of injuries. Such a system would ideally be easily adjustable, allowing skateboarders to quickly engage or disengage based on their immediate needs. Moreover, a system that doubles as a carrying solution would address the transportation challenge, adding an additional layer of utility.

Further, certain skateboard tricks, notably the ollie, demand intricate synchronization between foot movement and board control. The ollie, often considered a foundational trick, requires the skateboarder to simultaneously slide the front foot forward and pop the tail of the board downwards. This motion, if executed correctly, allows the board to lift off the ground in a jumping motion. However, maintaining the necessary foot-to-griptape coupling during this maneuver is challenging, even for seasoned skateboarders. Without adequate traction, there's a heightened risk of the foot slipping off, leading to incomplete tricks or potential mishaps. While the griptape on the deck does offer some friction, it may not provide sufficient grip, especially when the board is airborne. This lack of secure foot-to-board connection can deter skateboarders from attempting more advanced variations of the trick or integrating it into more complex routines. Hence, there's a distinct need for an accessory that ensures consistent foot adherence to the skateboard's deck, allowing skateboarders to execute tricks like the ollie with greater precision and confidence.

Therefore, it would be advantageous to provide a skateboard foot strap system, as presented herein, promises to bridge these identified gaps in the skateboard accessory industry. By providing a removable tension strap with beveled discs, this system offers skateboarders a robust mechanism to enhance foot grip during tricks while also serving as a convenient carrying solution. The adaptability of the tension and the potential for reduced material cost further make this system a promising solution to the problems identified in the current skateboard accessory landscape.

DETAILED DESCRIPTION OF THE INVENTION

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a skateboard foot strap system" or any of its constituent parts also includes a plurality of skateboard foot strap systems or any of its constituent parts and the like.

Figure 1A:
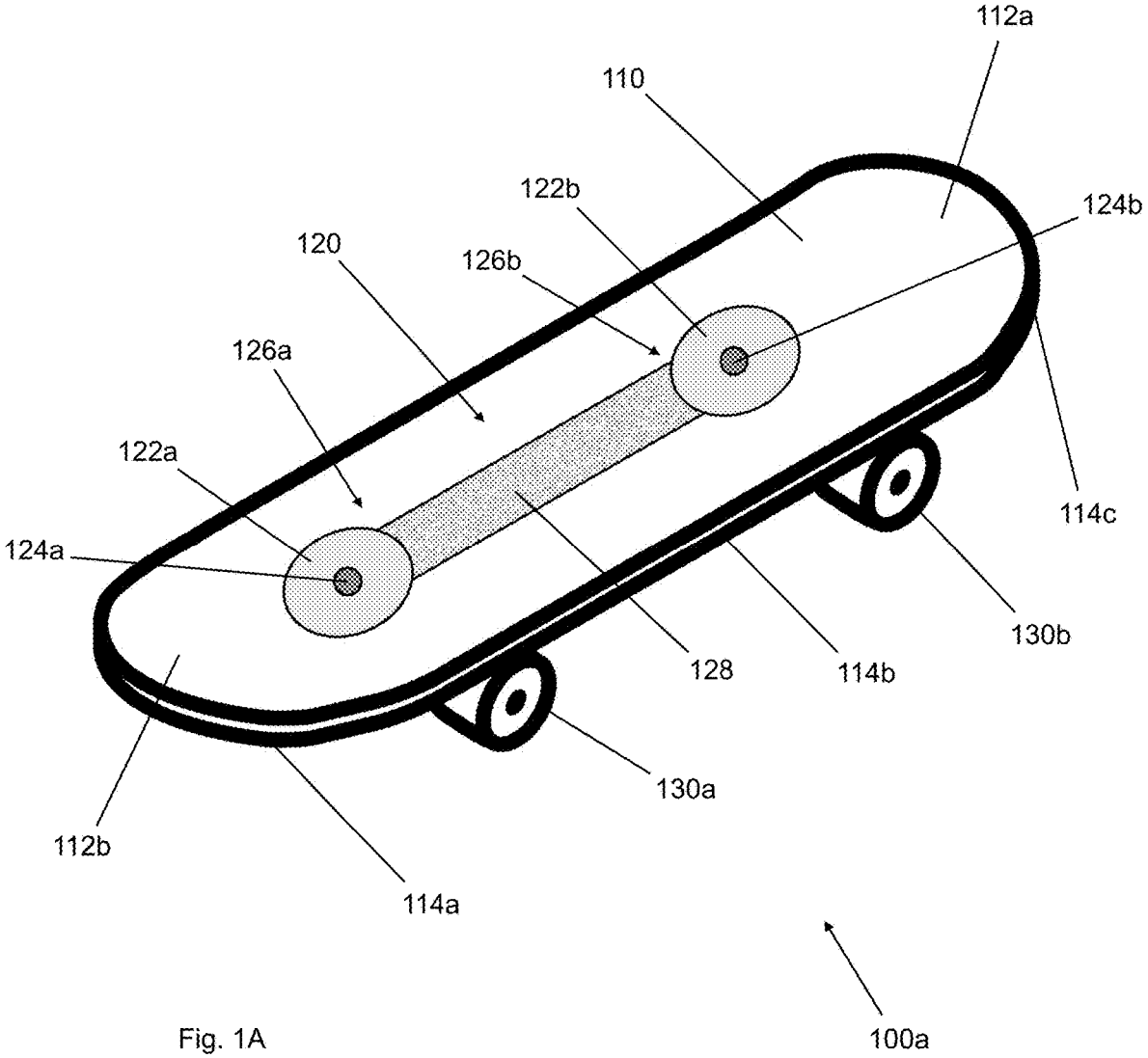
FIG. 1A illustrates a perspective view of a skateboard foot strap system 120 coupled to a deck 110 of a skateboard 100*a* in accordance with some embodiments of the present invention.

Exemplary embodiments of the present invention are illustrated in the accompanying figures. As shown in FIG. 1A, a perspective view of a skateboard foot strap system 120 coupled to a deck 110 of a skateboard 100*a* is provided. The skateboard 100*a* may comprise the skateboard foot strap system 120 coupled to the top surface of the deck 110 through a griptape layer disposed over a top surface thereof. The deck 110 may comprise first and second sets of wheels 130*a*, 130*b* disposed upon a bottom surface thereof opposite that of the first surface. The deck 110 may comprise a nose portion 112*a* and a tail portion 112*b* disposed at opposite ends thereof as illustrated in FIG. 1A. Further, the structure of the deck 110 may comprise a distal concave terminal end 114*a*, a central planar section 114*b*, and a proximal concave terminal end 114*c*.

The foot strap system 120 may comprise a distal coupling disc 122*a* and a proximal coupling disc 122*b* which each may comprise a distal structural depression 124*a* and a proximal structural depression 124*b*, respectively. Further, the foot strap system 120 may comprise an elongate flexible foot strap 128 coupled to and between the distal and proximal coupling discs 122*a*, 122*b* at respective coupling interface areas 126*a*, 126*b*. The distal and proximal structural depressions 124*a*, 124*b* may be disposed symmetrically within a central focal point of the circular shape of the respective proximal and distal coupling discs 122*a*, 122*b*. Similarly, the elongate flexible foot strap 128 may be disposed symmetrically about an axis running through the central focal point of the circular shape of the respective proximal and distal coupling discs 122*a*, 122*b* and thereby the distal and proximal structural depressions 124*a*, 124*b* may be disposed symmetrically about the same axis. It would be advantageous to provide the elongate flexible foot strap 128 such that it comprises a first width dimension smaller than that of a second width dimension of each of the proximal and distal coupling discs 122*a*, 122*b* as shown in FIG. 1A in order to allow the strap 128 to pass between threaded bolts that extend from a bottom planar surface of the discs 122*a*, 122*b* which thereby allows more robust securement of the strap 128 under the discs 122*a*, 122*b* and directly adjacent the bottom planar surfaces thereof.

Figure 1B:
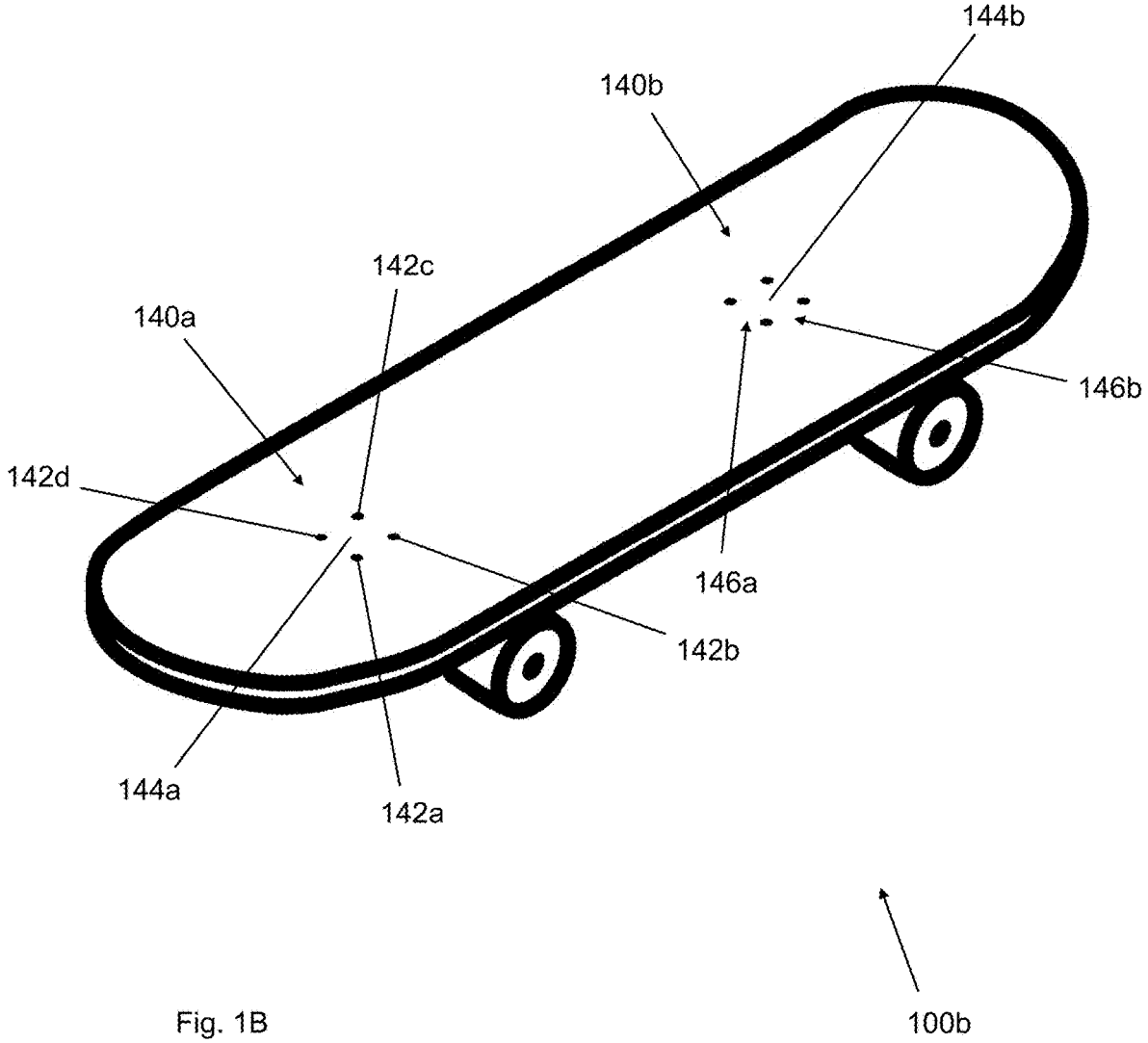
FIG. 1B illustrates a perspective view of a skateboard 100*b* having first and second sets of coupling apertures 140*a*, 140*b* where a skateboard foot strap system would be coupled to the deck of the skateboard 100*b* in accordance with some embodiments of the present invention.

As shown in FIG. 1B, a perspective view of a skateboard 100*b* having first and second sets of coupling apertures 140*a*, 140*b* where a skateboard foot strap system would be coupled to the deck of the skateboard 100*b* is provided. The skateboard 100*b* of FIG. 1B may be substantially similar to that of the skateboard 100*a* as described and illustrated with respect to FIG. 1A except that the skateboard 100*b* does not have the foot strap system 120 coupled thereto which thereby reveals the first and second sets of coupling apertures 140*a*, 140*b*.

The skateboard 100*b* may comprise the first and second sets of coupling apertures 140*a*, 140*b* disposed symmetrically about a length-wise dimension of thereof. Each set of coupling apertures 140*a*, 140*b* may respectively comprise first, second, third and fourth apertures 142*a*-142*d* arranged in a square configuration in order to complimentarily accept threaded bolts of the coupling discs 122*a*, 122*b* of FIG. 1A. Between each set of apertures 142*a*-142*b* may be disposed respective band coupling areas 144*a*, 144*b* which are each defined by a lengthwise band coupling channel 146*a* and a widthwise band coupling channel 146*b*.

The lengthwise band coupling channel 146*a* may be defined as the band coupling area starting between first and fourth apertures 142*a*, 142*d* and extending between second and third apertures 142*b*, 142*c* along a lengthwise axis running through the widthwise midpoint of the deck of the skateboard 100*b*. The widthwise band coupling channel 146*b* may be defined as the band coupling area starting between first and second apertures 142*a*, 142*b* and extending between third and fourth apertures 142*c*, 142*d* along a widthwise axis running through the respective lengthwise midpoint of each of the band coupling areas 144*a*, 144*b*.

Figure 2A:
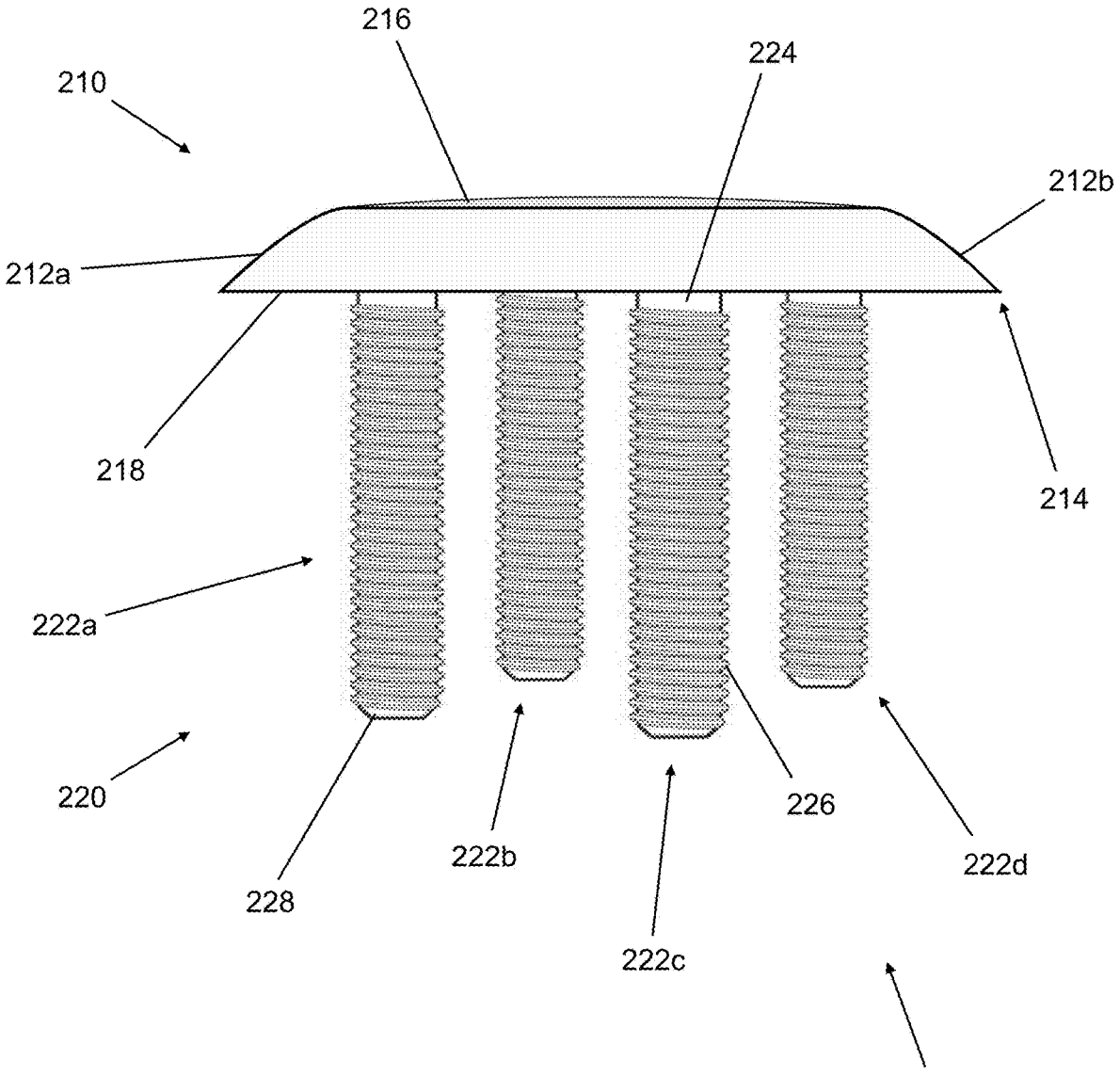
FIG. 2A illustrates an elevational side view of a coupling disc 200*a* of a skateboard foot strap system in accordance with some embodiments of the present invention.

As shown in FIG. 2A, an elevational side view of a coupling disc 200*a* of a skateboard foot strap system is provided. The coupling disc 200*a* may comprise a top portion 210 and a bottom portion 220. The top portion 210 may comprise distal and proximal concave down edge structures 212*a*, 212*b* that define a concave down rounded shape running along the circumferential edge of each coupling disc 200*a*. Each of the distal and proximal concave down edge structures 212*a*, 212*b* may terminate into a planar top surface 216 and may also terminate into a planar bottom surface 218.

When terminating into the planar top surface 216, the distal and proximal concave down edge structures 212*a*, 212*b* form an obtuse coupling angle with the planar top surface 216 as illustrated in FIG. 2A. When terminating into the planar bottom surface 218, the distal and proximal concave down edge structures 212*a*, 212*b* form an acute coupling angle with the planar bottom surface 218 at a peripheral edge ridge 214 as illustrated in FIG. 2A. Such obtuse and acute coupling angles are advantageous to utilize in order to provide a coupling disc 200*a* that is as low profile as possible in order to allow the user to optimize performance of tricks while also optimizing robustness of the securement of the elongate flexible strap thereunder as illustrated and described in relation to FIG. 1A.

The coupling disc 200*a* is thoughtfully designed to accommodate the nuanced topography of a skateboard's deck. Notably, the top portion 210 is oriented at a few degree offset from an orthogonal orientation relative to the bottom portion 220. This deliberate design choice ensures that the planar bottom surface 218 rests flush against the slightly concave up structure of the skateboard's nose and tail. By mirroring the subtle curve of the skateboard's griptape surface, the coupling disc 200*a* ensures a more intimate and stable interface between the components without disadvantageously abrading the griptape of the skateboard. In this embodiment, the four threaded bolts 222*a*-222*d* of the bottom portion 220 must also extend from the planar bottom surface 218 with the same few degree offset from orthogonal.

In this an other related paragraphs, the term "few degree offset" may be interpreted to mean a range of angular offsets between 1 degree and 8 degrees, but more preferably between 2 degrees and 5 degrees in order to be more complimentary to the typical curvature range of the nose and tail of various skateboards in the industry. In this context, the top portion 210 may be oriented at a 1 degree to 8 degree offset from an orthogonal orientation relative to the bottom portion 220, but more preferably between 2 degrees and 5 degrees. Further, the four threaded bolts 222*a*-222*d* of the bottom portion 220 may be oriented at a 1 degree to 8 degree offset from an orthogonal orientation relative to the planar bottom surface 218, but more preferably between 2 degrees and 5 degrees.

The few degree offset integrated into the top portion 210 offers multiple advantages. Firstly, it guarantees that the entirety of the planar bottom surface 218 makes contact with the griptape, enhancing the efficacy and durability of the attachment. Additionally, by seamlessly adhering to the natural curvature of the skateboard's nose and tail, it minimizes potential interference with the skateboarder's maneuvers. Such conformity with the skateboard's design not only maintains the board's aesthetic appeal but also ensures that the coupling disc 200*a* does not become a hindrance during tricks or routines. In essence, this design intricacy accentuates the synergy between the skateboard's inherent form and the added functionality of the coupling disc 200*a*.

The bottom portion 220 may comprise four threaded bolts 222*a*-222*d* robustly coupled to and extending from the planar bottom surface 218. Specifically, the four threaded bolts 222*a*-222*d* may be disposed in a square pattern relative one another such that each of the threaded bolts 222*a*-222*d* are disposed at respective vertices of the square pattern. Further, the four threaded bolts 222*a*-222*d* may symmetrically extend from planar bottom surface in the square pattern such that the square pattern is centered about a focal point of the circular planar bottom surface 218 of the coupling disc 200*a*.

Each of the threaded bolts 222*a*-222*d* may comprise a shank portion 224 which are disposed directly adjacent the planar bottom surface 218 of the top portion 210. Further, each of the threaded bolts 222*a*-222*d* may comprise a thread portion 226 which is shaped to accept a complimentary threaded bolt thereupon after being disposed through the apertures 142*a*-142*d* of FIG. 1B and complimentary apertures aligned therewith through the trucks of the skateboard attached under the deck. Finally, each of the threaded bolts 222*a*-222*d* may comprise a planar tip portion 228 at which point each of the bolts 222*a*-222*d* may terminate.

Figure 2B:
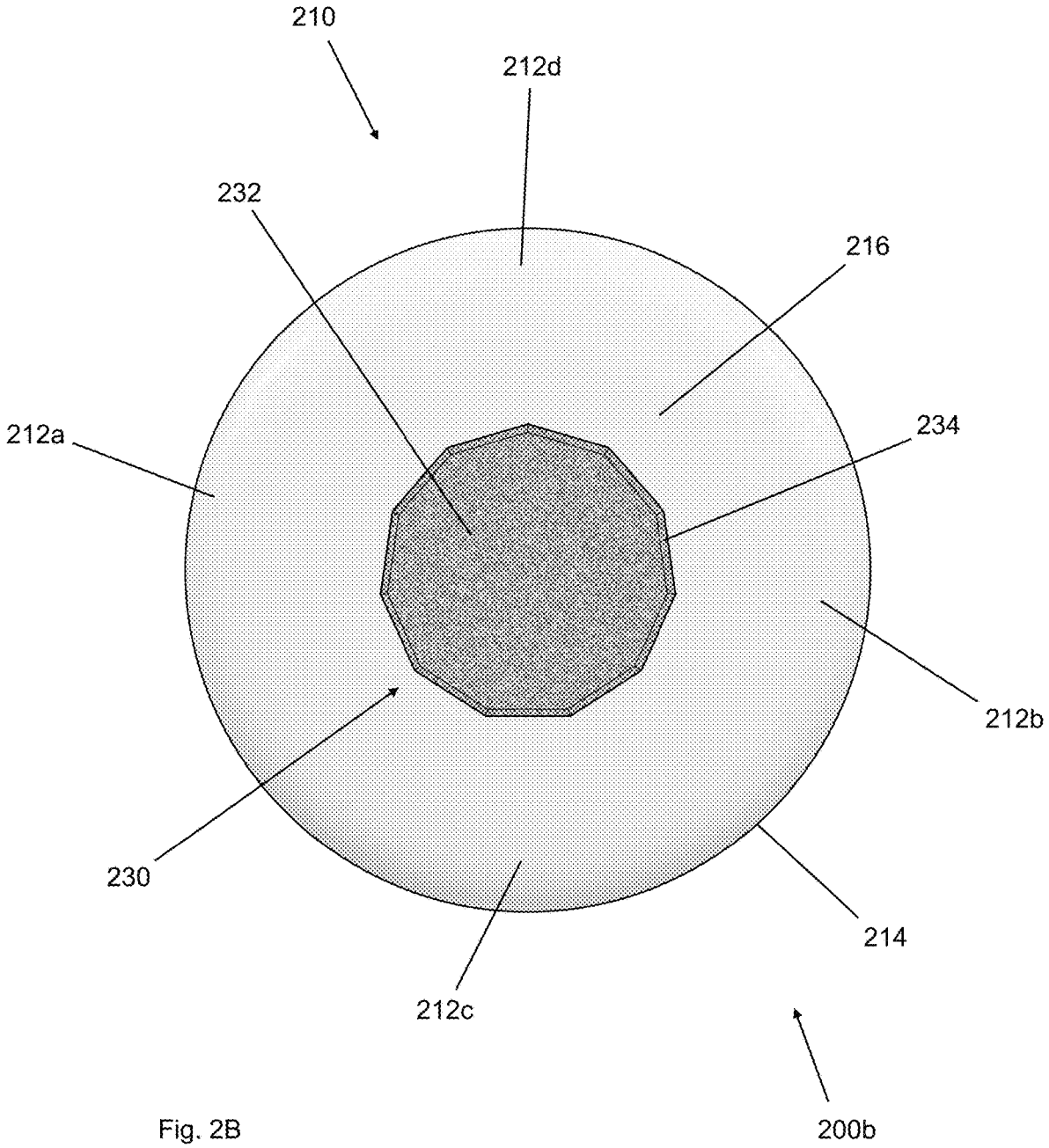
FIG. 2B illustrates a top perspective view of a coupling disc 200*b* of a skateboard foot strap system in accordance with some embodiments of the present invention.

As shown in FIG. 2B, a top perspective view of a coupling disc 200*b* of a skateboard foot strap system is provided. The coupling disc 200*b* may comprise an outer disc structure top portion 210 having left, right, bottom and top concave down edge structures 212*a*-212*d*. Each of the concave down edge structures 212*a*-212*d* may be structurally continuous with one another in order to define a concave down rounded shape running along a peripheral edge 214 of each coupling disc 200*b*. Each of the concave down edge structures 212*a*-212*d* may also each structurally terminate into a planar top surface 216 in a continuous manner in order to seamlessly transition into the planar shape of the top surface 216 as illustrated in FIG. 2B.

The coupling disc 200*b* may further comprise a structural depression 230 disposed symmetrically about a focal point of the circular shape (from an overhead perspective) of the disc 200*c* as illustrated in FIG. 2B. The structural depression 230 may comprise a recessed bottom surface 232 enclosed by a vertical edge 234. The recessed bottom surface 232 and the vertical edge 234 may together form a custom shape which may be stamped into the structure of the coupling disc 200*b* during fabrication thereof in order to make the coupling disc 200*b* more lightweight which enhances the performance capability of the skateboard overall by allowing a user to get more height during jumps with the skateboard due to reduced disc 200*b* weight which allows the user more air time to perform a greater number of tricks and a higher complexity of tricks while achieving greater height on those tricks which is desirable in obtaining the highest scores during skateboard trick competitions.

Additionally, the structural depression 230 may be custom-ordered by the user in order to reflect a desired shape or design during the fabrication process so that the user not only achieves greater skateboard performance due to reduced skateboard weight but also retains the uniqueness of their skateboard aesthetic which does not exist in existing skateboard hardware and it uniquely advantageous in the industry of skateboarding where users desire a high degree of individuality and creative design.

Figure 2C:
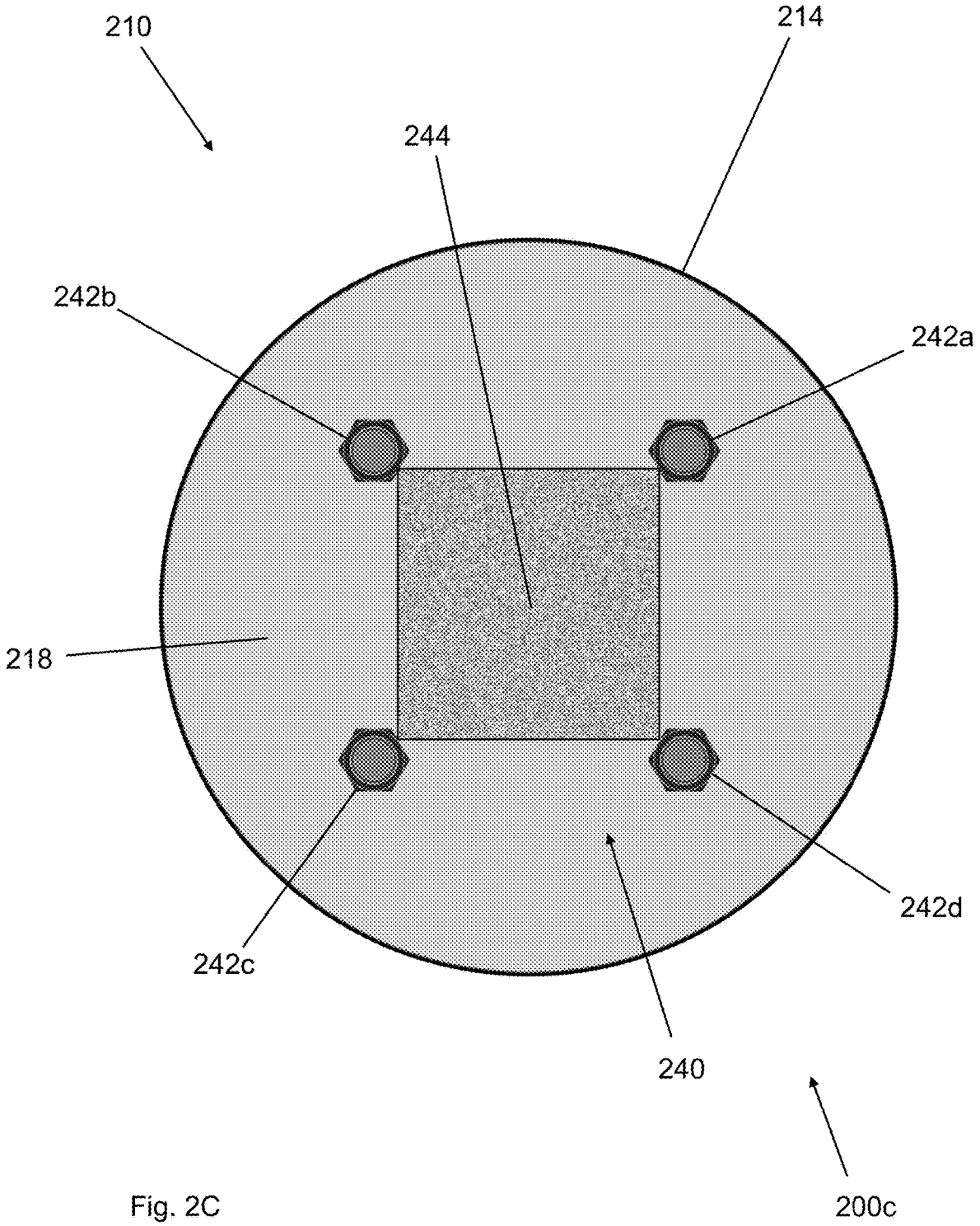
FIG. 2C illustrates a bottom plan view of a coupling disc 200*c* of a skateboard foot strap system showing a gripping structure 244 in accordance with some embodiments of the present invention.

As shown in FIG. 2C, a bottom plan view of a coupling disc 200*c* of a skateboard foot strap system showing a gripping structure 240 is provided. The coupling disc 200*c* may comprise an outer disc structure top portion 210 partially defined by a peripheral edge 214 which is the circumferential termination point of a circular planar bottom surface 218 of the coupling disc 200*c*. The circular planar bottom surface 218 may comprise a plurality of threaded bolt and nut pairs 242*a*-242*d* extending therefrom in a square pattern. The square pattern may be symmetrically disposed about a focal point of the circular shape of the planar bottom surface 218.

Further, the gripping structure 240 is illustrated in FIG. 2C as being a rectangular shape but may be any shape that is capable of being symmetrically disposed about the same focal point of the circular shape of the planar bottom surface 218. The gripping structure 240 may be disposed over a band coupling area disposed between the plurality of threaded bolt and nut pairs 242*a*-242*d*. The band coupling area 240 may be the area between the coupling disc 200*c* and the deck of the skateboard which accepts the elongate flexible foot strap 128 of FIG. 1A therein.

Moreover, the gripping structure 240 may be designed and structured to act a retention mechanism for the elongate flexible foot strap 128 after it is secured within the band coupling area 240 between the planar bottom surface 218 of the coupling disc 200*c* and the deck of the skateboard. The gripping structure 240 may be advantageously implemented as a layer of high-friction material 244 such as, but not limited to, silicone, rubber, abrasive polymers and the like or any combination thereof so as to add to the robustness of the coupling strength of the coupling disc 200*c* while the elongate flexible foot strap 128 is experiencing extreme forces being applied to it during use of the skateboard by the user. This more robustly secures the strap 128 in place during use which further decreases risk of the strap 128 slipping out of its coupled arrangement and causing injury to the user.

Figure 2D:
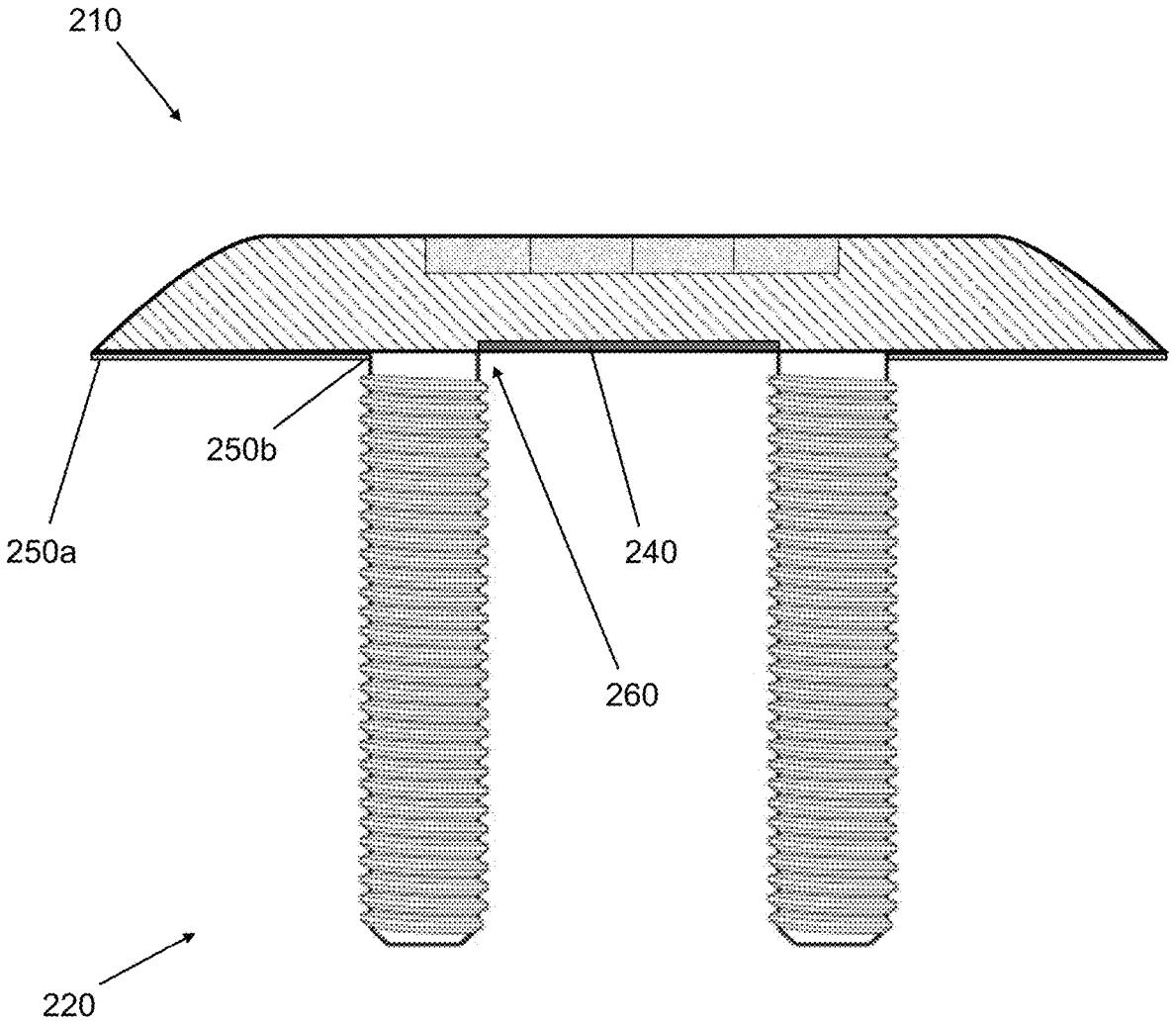
FIG. 2D illustrates a partial cross-sectional view of a coupling disc 200*d* of a skateboard foot strap system in accordance with some embodiments of the present invention.

As shown in FIG. 2D, a partial cross-sectional view of a coupling disc 200*d* of a skateboard foot strap system is provided. The coupling disc 200*d* may comprise an outer disc structure top portion 210 as previously described and illustrated with respect to FIGS. 2A-2C. However, the bottom planar surface 218 of previous embodiments includes a deformable protective layer extending from a peripheral edge portion 250*a* adjacent the peripheral edge 214 of FIG. 2A to an interior edge portion 250*b* adjacent the threaded bolts 222*a*-222*d* of FIG. 2A.

The deformable protective layer defined by portions 250*a*, 250*b* may act as a stabilizing layer which stabilizes the coupling interface between the coupling disc 200*d* and the griptape of the deck of the skateboard. Moreover, the deformable protective layer defined by portions 250*a*, 250*b* may act as a means of protecting the griptape of the deck of the skateboard by preventing abrasion thereof by relative movement of the coupling disc 200*d* while the skateboard is in use. Thereby, if a user decides not to use the skateboard foot strap system for a time, then there are not circular abrasion marks left upon the griptape of the user's skateboard which would be disadvantageous for the user and would be a deterrent for the user to continue using the skateboard foot strap system.

Additionally, FIG. 2D illustrates the gripping structure 240 being recessed into the planar bottom surface 218 of FIG. 2A such that the band coupling area may be partially defined by the recessed area of the planar bottom surface 218 and the gripping structure 240 disposed within the recess. Such a design would be advantageous in allowing the gripping structure 240 to have a reduced form factor which allows the coupling discs 200*d* to have a minimized height above the deck of the skateboard which in turn allows for a more even deck surface and thereby a more user-friendly skateboard allowing for more tricks to be performed. The terminal edges 260 of the recessed gripping structure 240 may be disposed adjacent the threaded bolts 222*a*-222*d* of FIG. 2A but on a side opposite that of the interior edge portion 250*b* as illustrated in FIG. 2D.

Figure 3:
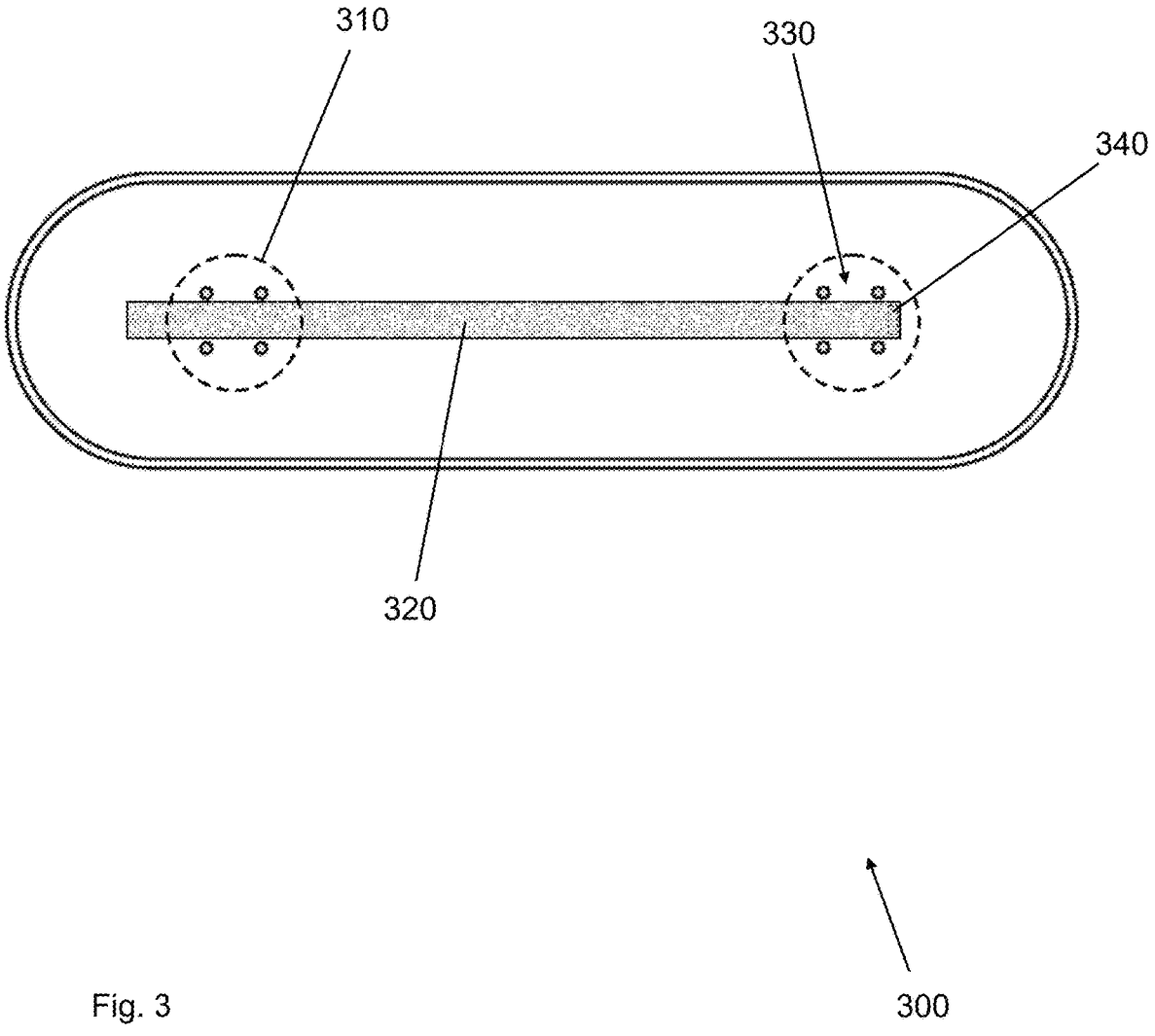
FIG. 3 illustrates a top plan view of a skateboard foot strap system 300 showing a pair of coupling discs 310 in phantom in order to illustrate the alignment of an elongate flexible foot strap 320 in accordance with some embodiments of the present invention.

As shown in FIG. 3, a top plan view of a skateboard foot strap system 300 showing a pair of coupling discs 310 in phantom in order to illustrate the alignment of an elongate flexible foot strap 320 is provided. The skateboard foot strap system 300 may comprise the coupling discs 310 in phantom respectively disposed over the sets of coupling apertures with the elongate flexible foot strap 320 disposed through a band coupling area 330 of the deck of the skateboard and specifically through a lengthwise band coupling channel 146*a* of FIG. 1B.

Additionally, the elongate flexible foot strap 320 may comprise a terminal retention mechanism 340 disposed at a proximal end of the strap 320 and under the proximal coupling disc 310. The terminal retention mechanism 340 may allow the user to removably attach the proximal end of the strap 320 to the proximal coupling disc 310 or a proximal portion of the deck of the skateboard before securing the distal end of the strap 320 under the distal coupling disc 310 which allows the user to more easily adjust the strap 320 under the coupling discs 310 to select for a precise strap 320 length which will determine the tension of the strap 320 across the surface of the deck and the user's foot or feet secured thereunder as well. Such fine adjustment capability of the terminal retention mechanism would be advantageous to provide in order to allow the user the ability to very precisely select the foot space underneath the coupled strap 320 which will be determined by the user based upon the user's specific foot and shoe size as well as the desired trick the user is attempting to perform and even the grip-strength of the griptape of the user's skateboard relative the sole of the user's shoes.

Figure 4:
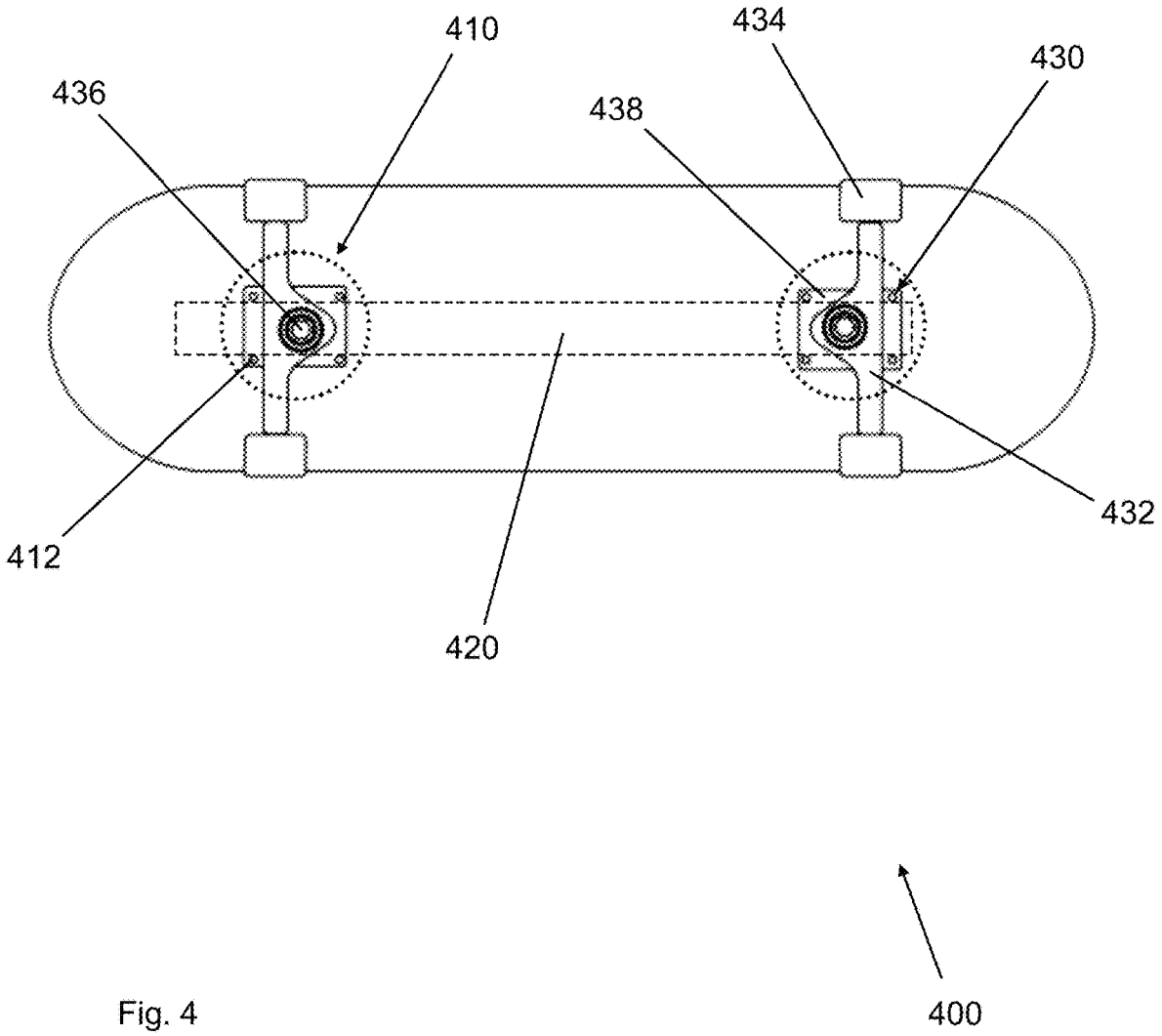
FIG. 4 illustrates a bottom plan view of a skateboard foot strap system 400 showing a pair of coupling discs 410 and an elongate flexible foot strap 420 in phantom in order to illustrate the alignment of the foot strap 420 relative sets of coupling apertures 412 disposed through respective skateboard trucks 430 in accordance with some embodiments of the present invention.

As shown in FIG. 4, a bottom plan view of a skateboard foot strap system 400 showing a pair of coupling discs 410 and an elongate flexible foot strap 420 in phantom in order to illustrate the alignment of the foot strap 420 relative sets of coupling apertures 412 disposed through respective skateboard trucks 430 is provided. The skateboard foot strap system 400 may comprise the skateboard trucks 430 coupled to a bottom side of the skateboard deck via the threaded bolt and nut sets of the coupling discs 410 being disposed and secured through the coupling apertures 412. The elongate flexible foot strap 420 is illustrated as being disposed through a lengthwise band coupling channel 146*a* of FIG. 1B which also aligns along a lengthwise axis running through the widthwise midpoint of the skateboard trucks 430.

The skateboard trucks 430 of the skateboard foot strap system 400 may each comprise a truck hangar 432 coupled to a truck base plate 438 via a kingpin and washer system 436 in such a manner that the truck base plate 438 is disposed directly adjacent a bottom surface of the deck of the skateboard. Further, the truck hangar 432 may comprise two elongate members terminating into respective axels each having a wheel 434 coupled thereto via an axle nut, spacer and bearing. Additionally, the truck base plate 438 may comprise coupling apertures disposed therethrough which may be aligned with the coupling apertures of the coupling discs as illustrated and described with respect to some of FIGS. 1A-3.

In some embodiments of FIGS. 1A-4, a skateboard foot strap system is provided comprising a plurality of coupling discs each having a top portion and bottom portion, wherein: the top portion comprises a plurality of concave down edge structures, each of the plurality of concave down edge structures terminates into a planar top surface, each of the plurality of concave down edge structures terminates into a planar bottom surface, and the bottom portion comprises a plurality of threaded bolts extending from the planar bottom surface and structured to be disposed through respective coupling apertures; and an elongate flexible foot strap having a first width dimension smaller than that of a second width dimension of each of the plurality of coupling discs, wherein: the elongate flexible foot strap is disposed between the plurality of threaded bolts, and the elongate flexible foot strap is disposed directly adjacent the planar bottom surface of each of the plurality of coupling discs.

In some embodiments of FIGS. 1A-4, each of the plurality of threaded bolts comprises a shank portion disposed directly adjacent the planar bottom surface, each of the plurality of threaded bolts comprises a thread portion shaped to accept a complimentary threaded bolt thereupon after being disposed through the respective coupling apertures, each of the plurality of threaded bolts comprises a planar tip portion disposed at the terminal end of the thread bolt and furthest away from the planar bottom surface, each of the plurality of threaded bolts comprises a threaded portion disposed between a shank portion and a planar tip portion, each of the plurality of coupling discs comprises a structural depression formed into an outer surface thereof, and the structural depression comprises a recessed bottom surface enclosed by a vertical edge.

In some embodiments of FIGS. 1A-4, the coupling apertures are partly defined by skateboard deck apertures, the coupling apertures are party defined by skateboard truck apertures, the skateboard deck apertures are aligned with the skateboard truck apertures, the plurality of threaded bolts are each structured to be disposed through respectively aligned skateboard deck apertures and skateboard truck apertures, and after the plurality of threaded bolts are disposed through the respectively aligned skateboard deck apertures and skateboard truck apertures, complimentary threaded nuts are disposed around a threaded portion of each of the plurality of threaded bolts.

In some embodiments of FIGS. 1A-4, the skateboard deck apertures are disposed through a deck and a griptape layer of a skateboard, the deck of the skateboard comprises a first lengthwise axis running symmetrically through a first widthwise midpoint of the deck, the skateboard truck apertures are disposed through a skateboard truck of a skateboard, the skateboard truck of the skateboard comprises a second lengthwise axis running symmetrically through a second widthwise midpoint of the skateboard truck, the first lengthwise axis is parallel to the second lengthwise axis, the coupling apertures are disposed about a widthwise axis running running symmetrically through a lengthwise midpoint of the coupling apertures, and the widthwise axis is disposed orthogonal relative the first and second lengthwise axes.

In some embodiments of FIGS. 1A-4, a skateboard foot strap system is provided comprising a plurality of coupling discs each having a top portion and bottom portion, wherein: the top portion comprises a plurality of concave down edge structures, each of the plurality of concave down edge structures terminates into a planar top surface, in terminating into the planar top surface, the plurality of concave down edge structures form an obtuse coupling angle with the planar top surface, each of the plurality of concave down edge structures terminates into a planar bottom surface, in terminating into the planar bottom surface, the plurality of concave down edge structures form an acute coupling angle with the planar bottom surface at a peripheral edge ridge, and the bottom portion comprises a plurality of threaded bolts extending from the planar bottom surface and structured to pass through respective coupling apertures; and an elongate flexible foot strap having a first width dimension smaller than that of a second width dimension of each of the plurality of coupling discs, wherein: the elongate flexible foot strap is disposed between the plurality of threaded bolts, and the elongate flexible foot strap is disposed directly adjacent the planar bottom surface of each of the plurality of coupling discs.

In some embodiments of FIGS. 1A-4, a skateboard foot strap system is provided comprising a plurality of coupling discs each having a top portion and bottom portion, wherein: the top portion comprises a plurality of concave down edge structures, each of the plurality of concave down edge structures terminates into a planar top surface, each of the plurality of concave down edge structures terminates into a planar bottom surface, and the bottom portion comprises a plurality of threaded bolts extending from the planar bottom surface and structured to pass through respective coupling apertures; and an elongate flexible foot strap having a first width dimension smaller than that of a second width dimension of each of the plurality of coupling discs, wherein: the elongate flexible foot strap is disposed between the plurality of threaded bolts, the coupling apertures comprise a first set of coupling apertures and a second set of coupling apertures, the first and second set of coupling apertures are each disposed such that respective band coupling areas are formed between each of the coupling apertures of each of the first and second set of coupling apertures, a proximal end of the elongate flexible foot strap is disposed at a proximal band coupling area of the respective band coupling areas through a proximal end of a lengthwise band coupling channel, a distal end of the elongate flexible foot strap is disposed at a distal band coupling area of the respective band coupling areas through a distal end of the lengthwise band coupling channel, a proximal end of the elongate flexible foot strap is disposed at a proximal band coupling area of the respective band coupling areas through a proximal end of a lengthwise band coupling channel, a distal end of the elongate flexible foot strap is disposed at a distal band coupling area of the respective band coupling areas through a distal end of the lengthwise band coupling channel, and the elongate flexible foot strap is disposed directly adjacent the planar bottom surface of each of the plurality of coupling discs.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or" connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A skateboard foot strap system, comprising:

a plurality of coupling discs each having a top portion and bottom portion, wherein:

the top portion comprises a plurality of concave down edge structures, each of the plurality of concave down edge structures terminates into a planar top surface, each of the plurality of concave down edge structures terminates into a planar bottom surface, and the bottom portion comprises a plurality of threaded bolts extending from the planar bottom surface and structured to be disposed through respective coupling apertures; and an elongate flexible foot strap having a first width dimension smaller than that of a second width dimension of each of the plurality of coupling discs, wherein:

the elongate flexible foot strap is disposed between the plurality of threaded bolts, and the elongate flexible foot strap is disposed directly adjacent the planar bottom surface of each of the plurality of coupling discs.

2. The skateboard foot strap system of claim 1, wherein each of the plurality of threaded bolts comprises a shank portion disposed directly adjacent the planar bottom surface.

3. The skateboard foot strap system of claim 1, wherein each of the plurality of threaded bolts comprises a thread portion shaped to accept a complimentary threaded bolt thereupon after being disposed through the respective coupling apertures.

4. The skateboard foot strap system of claim 1, wherein each of the plurality of threaded bolts comprises a planar tip portion disposed at the terminal end of the thread bolt and furthest away from the planar bottom surface.

5. The skateboard foot strap system of claim 1, wherein each of the plurality of threaded bolts comprises a threaded portion disposed between a shank portion and a planar tip portion.

6. The skateboard foot strap system of claim 1, wherein each of the plurality of coupling discs comprises a structural depression formed into an outer surface thereof.

7. The skateboard foot strap system of claim 6, wherein the structural depression comprises a recessed bottom surface enclosed by a vertical edge.

8. The skateboard foot strap system of claim 1, wherein the coupling apertures are partly defined by skateboard deck apertures.

9. The skateboard foot strap system of claim 8, wherein the coupling apertures are party defined by skateboard truck apertures.

10. The skateboard foot strap system of claim 9, wherein the skateboard deck apertures are aligned with the skateboard truck apertures.

11. The skateboard foot strap system of claim 10, wherein the plurality of threaded bolts are each structured to be disposed through respectively aligned skateboard deck apertures and skateboard truck apertures.

12. The skateboard foot strap system of claim 11, wherein, after the plurality of threaded bolts are disposed through the respectively aligned skateboard deck apertures and skateboard truck apertures, complimentary threaded nuts are disposed around a threaded portion of each of the plurality of threaded bolts.

13. The skateboard foot strap system of claim 9, wherein the skateboard deck apertures are disposed through a deck and a griptape layer of a skateboard.

14. The skateboard foot strap system of claim 13, wherein the deck of the skateboard comprises a first lengthwise axis running symmetrically through a first widthwise midpoint of the deck.

15. The skateboard foot strap system of claim 14, wherein the skateboard truck apertures are disposed through a skateboard truck of a skateboard.

16. The skateboard foot strap system of claim 15, wherein the skateboard truck of the skateboard comprises a second lengthwise axis running symmetrically through a second widthwise midpoint of the skateboard truck.

17. The skateboard foot strap system of claim 16, wherein the first lengthwise axis is parallel to the second lengthwise axis.

18. The skateboard foot strap system of claim 17, wherein:

the coupling apertures are disposed about a widthwise axis running running symmetrically through a lengthwise midpoint of the coupling apertures, and the widthwise axis is disposed orthogonal relative the first and second lengthwise axes.

19. A skateboard foot strap system, comprising:

a plurality of coupling discs each having a top portion and bottom portion, wherein:

the top portion comprises a plurality of concave down edge structures, each of the plurality of concave down edge structures terminates into a planar top surface, in terminating into the planar top surface, the plurality of concave down edge structures form an obtuse coupling angle with the planar top surface, each of the plurality of concave down edge structures terminates into a planar bottom surface, in terminating into the planar bottom surface, the plurality of concave down edge structures form an acute coupling angle with the planar bottom surface at a peripheral edge ridge, and the bottom portion comprises a plurality of threaded bolts extending from the planar bottom surface and structured to pass through respective coupling apertures; and an elongate flexible foot strap having a first width dimension smaller than that of a second width dimension of each of the plurality of coupling discs, wherein:

the elongate flexible foot strap is disposed between the plurality of threaded bolts, and the elongate flexible foot strap is disposed directly adjacent the planar bottom surface of each of the plurality of coupling discs.

20. A skateboard foot strap system, comprising:

a plurality of coupling discs each having a top portion and bottom portion, wherein:

the top portion comprises a plurality of concave down edge structures, each of the plurality of concave down edge structures terminates into a planar top surface, each of the plurality of concave down edge structures terminates into a planar bottom surface, and the bottom portion comprises a plurality of threaded bolts extending from the planar bottom surface and structured to pass through respective coupling apertures; and an elongate flexible foot strap having a first width dimension smaller than that of a second width dimension of each of the plurality of coupling discs, wherein:

the elongate flexible foot strap is disposed between the plurality of threaded bolts, the coupling apertures comprise a first set of coupling apertures and a second set of coupling apertures, the first and second set of coupling apertures are each disposed such that respective band coupling areas are formed between each of the coupling apertures of each of the first and second set of coupling apertures, a proximal end of the elongate flexible foot strap is disposed at a proximal band coupling area of the respective band coupling areas through a proximal end of a lengthwise band coupling channel, a distal end of the elongate flexible foot strap is disposed at a distal band coupling area of the respective band coupling areas through a distal end of the lengthwise band coupling channel, and the elongate flexible foot strap is disposed directly adjacent the planar bottom surface of each of the plurality of coupling discs.

* * * * *